United States Patent [19]

Menzies et al.

[11] 4,311,119

[45] Jan. 19, 1982

[54] INTERNAL COMBUSTION ENGINES

[76] Inventors: Murray A. Menzies, C/- Waitaki New Zealand Refrigerating Limited, Balclutha; William G. Stevenson, 2/153 Songer St., Nelson, both of New Zealand

[21] Appl. No.: 27,505

[22] Filed: Apr. 5, 1979

[51] Int. Cl.[3] ..... F01L 7/00

[52] U.S. Cl. ..... 123/80 BB; 123/48 R; 123/190 BD; 123/190 E; 123/190 D

[58] Field of Search ..... 123/80 R, 80 BB, 80 D, 123/80 DA, 190 R, 190 A, 190 D, 190 E, 190 BD, 144, 151, 48 A, 48 AA, 78 AA

[56] References Cited

U.S. PATENT DOCUMENTS

| | | | |
|---|---|---|---|
| 1,427,726 | 8/1922 | Echard | 123/190 D |
| 2,154,505 | 4/1939 | Griffith | 123/78 AA |
| 2,283,594 | 5/1942 | Aspin | 123/190 D |
| 2,387,114 | 10/1945 | Bonbright et al. | 123/80 DA |
| 2,420,117 | 5/1947 | Weatherup | 123/48 AA |
| 3,395,680 | 8/1968 | Brooks | 123/190 R |
| 4,033,317 | 7/1977 | Aspin | 123/190 D |

FOREIGN PATENT DOCUMENTS

| | | | |
|---|---|---|---|
| 180772 | 1/1955 | Austria | 123/80 DA |
| 325474 | 3/1935 | Italy | 123/80 D |

*Primary Examiner*—Craig R. Feinberg
*Assistant Examiner*—W. Wolfe
*Attorney, Agent, or Firm*—Holman & Stern

[57] ABSTRACT

A rotary valve for an internal combustion engine is provided in the upper end of a cylinder to control intake and exhaust. A combustion chamber is formed in the valve and the valve is movable co-linearly with respect to the longitudinal axis of the cylinder under the control of a hydraulic fluid whereby the combustion forces on the valve are absorbed by the fluid and the valve can move in response to the pressures and vacuums in the cylinder. A special valve is provided for controlling the flow of the hydraulic fluid, and ducts are provided in the inlet and outlet ports with special seals engaging the rotary valve member.

7 Claims, 6 Drawing Figures

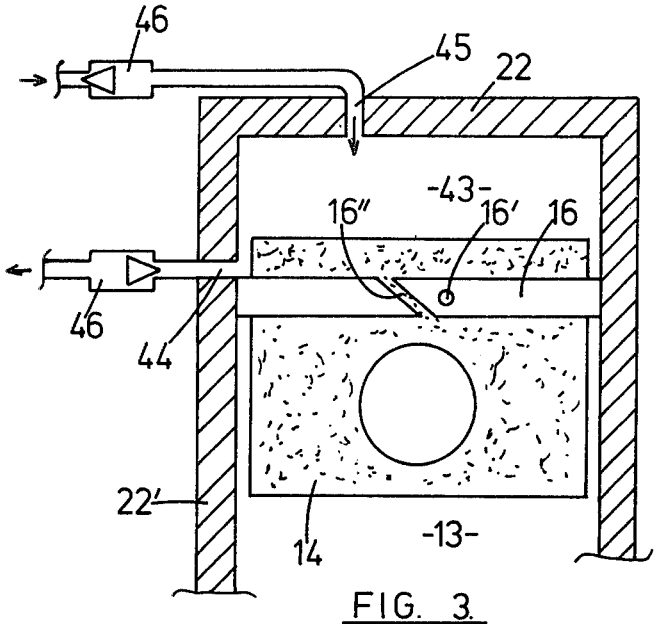
FIG. 3.
FIG. 4.
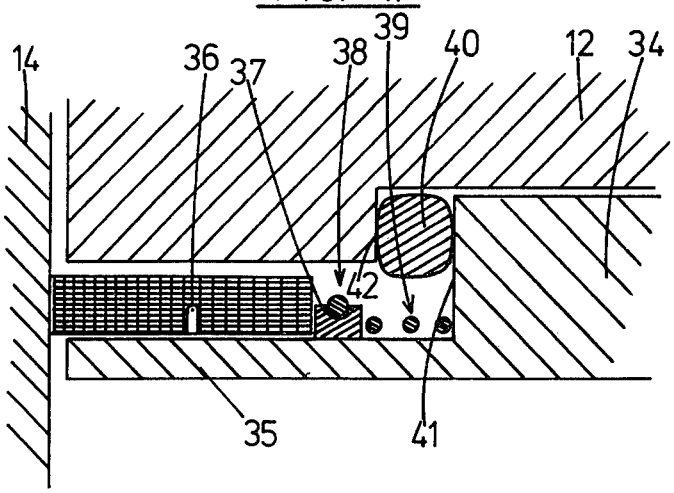

INTERNAL COMBUSTION ENGINES

This invention relates to an improved internal combustion engine and more particularly to a rotary valve-operated internal combustion engine.

Internal combustion engines which employ a rotary valve for control of intake and exhaust functions in place of conventional poppet valves have previously been proposed. Such engines which have been widely reported are attributed to Aspin and Cross. The Aspin engine was of a vertical rotary valve configuration while the Cross engine was of horizontal configuration. Other rotary valve engines have been suggested and it is widely held that rotary valve engines have considerable advantages such as silent operation, low maintenance, good breathing characteristics, the ability to burn lean mixtures and the ability to run with ultra-high compression ratios. For example, it is claimed for the Aspin engine that at peak output the hand could be held quite close to the exhaust port without being burnt and that it could run quite effectively on air-fuel ratios as lean as 1:23 with exhaust gas entirely free from carbon monoxide and unburned hydrocarbons.

It is therefore quite evident that a rotary valve engine has advantages over poppet valve engines. The engines of Aspin and Cross have, however, slipped from consideration over a period of time mainly because the valves had to carry an enormous load of combustion on the sliding faces and this entailed very close tolerances and many engineering complications. Accordingly, neither engine was economically viable for true series production.

In the high compression rotary valve engine the charge is a fuel/air mixture and to be vaporized the fuel in this mixture requires heat. This heat is supplied by the increasing temperature created by the air in the charge being compressed. The end result of this process is that just prior to ignition, the air/fuel mixture has been converted into a true vapor, and this vapour is relatively cool as the heat created by the compression has been used in the vaporization process. This process of vaporization is important for a rotary valve engine because it is impossible in a poppet-valved engine due to the charge being ignited by the incandescent exhaust valve head before the process can be completed.

The main object of the invention is to provide a rotary valve-operated internal combustion engine having such a construction and arrangement that the aforementioned high combustion forces experienced by the valve are maintained at an accepted level.

Broadly the invention consists of a rotary valve operated internal combustion engine having a cylinder with a piston located for reciprocating movement within the cylinder, a rotary valve member positioned at the combustion end of the cylinder, a combustion space formed in the valve member, means for moving the valve member so that the combustion space is successively indexed with an inlet port, a spark plug and an exhaust port, said valve member being so mounted that it is capable in operation of axial movement with respect to the combustion end of the cylinder, the end of the valve member away from the said combustion end defining with the walls of the housing in which the valve member is located an hydraulic fluid receiving chamber, inlet and outlet means coupled to an hydraulic fluid reservoir for maintaining a required volume of fluid within the chamber whereby the forces of combustion on the valve member are absorbed by the fluid in the chamber and the valve member can move in response to the pressures and vacuums in the cylinder while the fluid in the chamber is maintained at the required volume.

BRIEF DESCRIPTION OF THE SEVERAL VIEWS OF THE DRAWINGS

In more fully describing the invention reference will be made to the accompanying drawings in which:

FIG. 3 is a schematic view of the hydraulic fluid chamber formed in the head, FIG. 4 is a detailed view of one form of sealing between the inlet or exhaust port tracts and the valve member.

DETAILED DESCRIPTION

Figure 1:
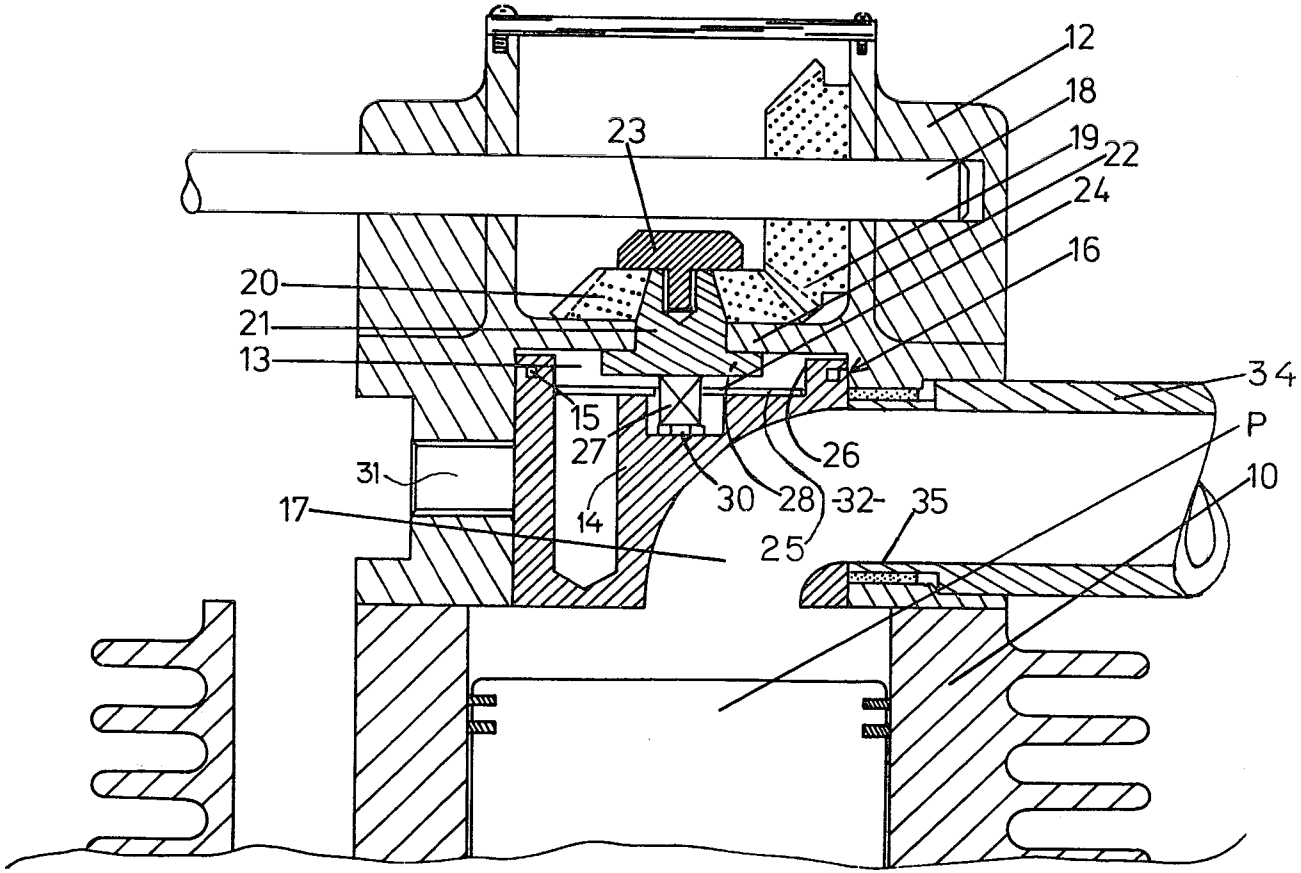
FIG. 1 is a sectional side view of an engine according to the present invention.
Figure 2:
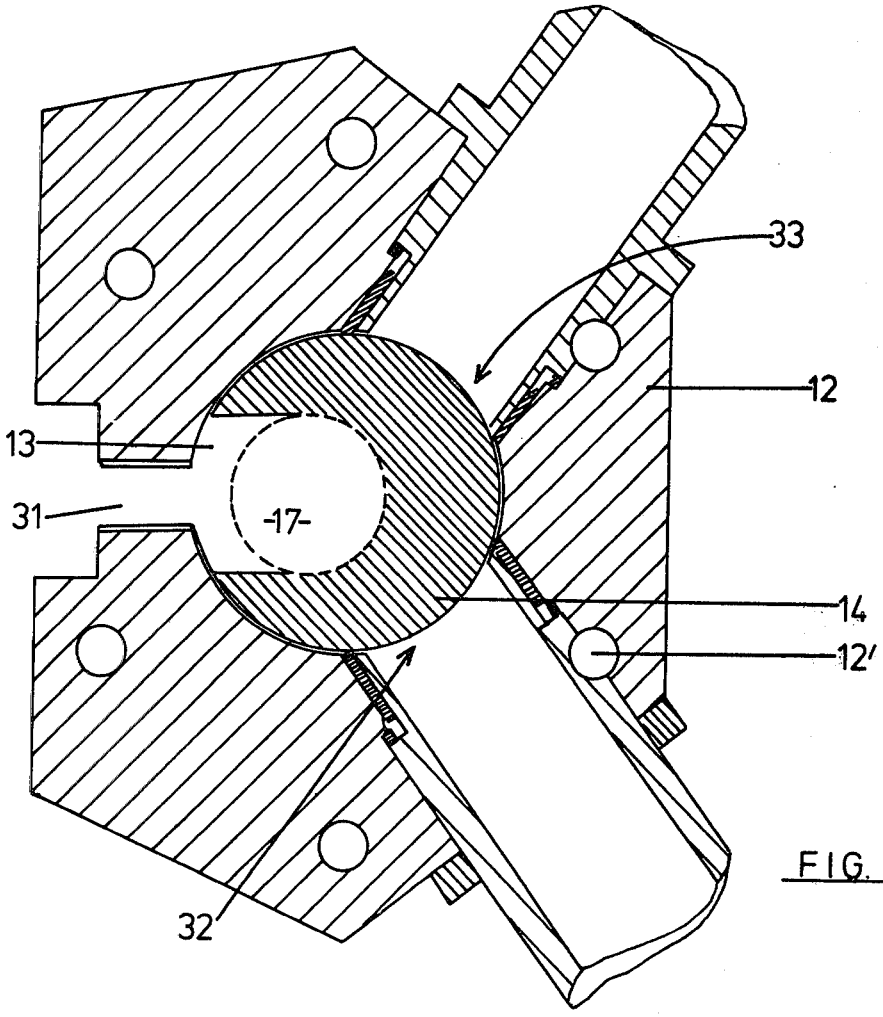
FIG. 2 is a plan view of the head of the engine.

Referring to FIG. 1 the cylinder 10 is of conventional design with a reciprocating piston 1 located therein. The head 12 is made by conventional construction methods and has openings 12' (see FIG. 2) for locating directly on to studs projecting from the cylinder. Accordingly the head 12 can be bolted directly onto an existing conventional 4 stroke engine.

The head has a centrally located cavity 13 which is of circular shape and in which valve member or rotor 14 fits. The rotor 14 is of circular cross section with an external diameter such that it fits within the cavity 13 with the required tolerances. A peripheral groove 15 is formed about the upper end of rotor 14 and a ring 16 locates therein. In the form shown ring 16 is of conventional design but is pinned at 16' adjacent its split 16'' so that it rotates in conjunction with rotor 14. Other forms of sealing between the rotor 14 and cavity walls can be employed and will be evident to a skilled person. A combustion cavity 17 is formed in the rotor 14 between the lower and peripheral wall thereof. A transverse shaft 18 is located in suitable bearings in the upper part of the head 12 and one end of which projects out from the head to be coupled to a drive. This drive can be in the form of a chain or toothed belt extending from the main crank of the engine. Where the head 12 is bolted directly to an engine which had a conventional overhead cam head the drive is conveniently provided by the existing cam drive arrangement. A bevel gear 19 is keyed onto shaft 18 and this meshes with a second bevel gear 20 disposed below shaft 18.

Bevel gear 20 has a tapered bore which engages with a similarly tapered stub shaft 21 projecting through transverse wall 22 which forms the roof of cavity 13. A bolt 23 fixedly attaches the bevel gear to stub shaft 21.

The upper face of the rotor 14 is recessed as shown at 26 and a plate 24 locates on a lip 25 in the recess. This plate 24 is bolted into the recess 26 and has a central square opening into which the similarly square dimension end 27 of stub shaft 21 fits. The stub shaft 21 has a landing or flange 28 which locates below the wall 22. A bolt 30 is screwed into a suitable tapped opening in the lower end of shaft 21 to prevent the rotor from falling from said shaft. The rotor 14 however, is not prevented by bolt 30 from axial movement along shaft 21.

The head 12 is provided with a threaded opening 31 for a spark plug and openings 32 and 33 for inlet and exhaust ducts. Each duct 34 is of tubular construction with a waisted end 35 which fits within the respective opening 32 and 33. Sealing arrangements are provided about the waisted end 35 to form a seal with the rotor 14. In FIG. 4 one such sealing arrangement is shown by way of illustration only. In this arrangement a main seal 36 is fitted about end 35 and this engages with the peripheral wall of rotor 14. A secondary 37 seal is located behind the main seal 36 and this is biassed by spring member 38 to firmly locate about the waisted end 35. A coil spring 39 is located between seal 37 and the shoulder 41 at the end of the waisted portion. A gasket 40 fits between the shoulder 41 and a shoulder 42 in the tract opening 32 or 33. Spring 39 ensures the main seal 36 maintains a constant sealing force with rotor 14.

Referring to FIG. 3 the chamber 43 formed by the upper face of the rotor 14 and walls of the cavity 13 is provided with a spill port 44 in side wall 22' and an inlet port 45 in wall 22. Non-return valves 46 are provided with each of the ports 44 and 45 and operate in the directions shown. In FIG. 3 rotor 14 is shown at the lower most point of its travel with ring 16 located below the spill port 44. Both ports are coupled to a main hydraulic fluid reservoir.

Rotor 14 is free to move axially in the cavity 13 a total of about 3 mm. Downward movement is limited by the interaction of the lower end of stub shaft 21 between its flange 28 and the plate 24. Upward movement is limited by the rotor seal moving across and closing spill port 44.

In operation the rotor 14 draws oil in the chamber 43 as it moves down slightly under the influence of vacuum on the intake stroke of piston 1. The amount of oil drawn in, and therefore the rotor movement, can be regulated by restricting the oil inlet port 45. Rotor 14 is next pushed up, with accompanying expelling of oil from chamber 43, by the compression pressure until spill port 44 is blanked off. As the oil inlet port 45 is located near the rotor axis and the spill port is on the peripheral wall 22 centrifuge action of the arrangement together with the pumping action of the rotor 14, causes the oil to be constantly circulated.

It is thus evident that the rotor floats in cavity 13 as dictated by the pressures and vacuums present in the cylinder and the oil pad in chamber 43. Accordingly, the combustion forces are taken by the oil pad which overcomes the problem associated with known types of rotary valve engines. This results in the engine being of simple design and having a lack of stressed reciprocating parts so that assembly and servicing of the engine is easy with the associated advantage of the engine being very reliable. As the rotor is floating between the oil on one side, and the various cylinder vacuums and pressures regardless of how low or high, on the other side there is never any pressure difference between the oil and the combustion chamber gases.

Figure 5:
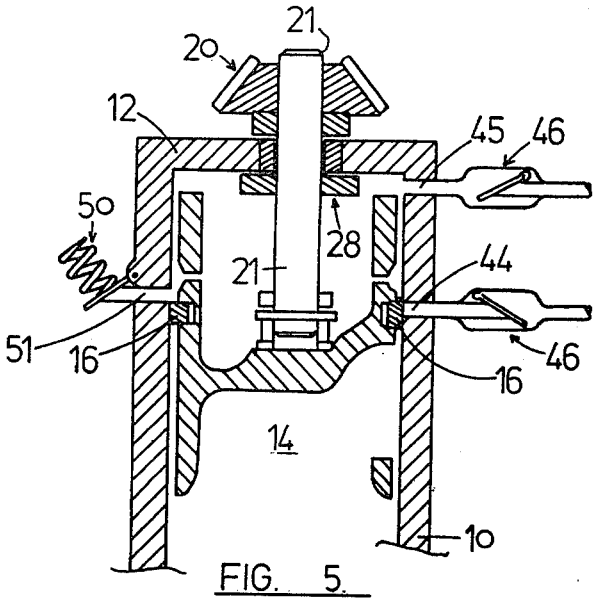
FIG. 5 is a schematic view of a second form of the engine according to the invention.

In FIG. 5 the engine is shown as being adapted for variable compression ratio operation. Valve 50 is a pressure relief valve set to lift at the maximum desired combustion pressure. This valve 50 is unrestricted so that only one cycle is necessary for the rotor 14 to move from maximum compression ratio (e.g. 20:1) to minimum compression ratio (e.g. 10:1). When the rotor has moved up to the minimum desired compression ratio (C.R.) the rotor seal 16 masks port 51 of valve 50 and renders the valve inoperative thus limiting the minimum C.R.

As with the previously described form of the invention non-return valve 45 supplies oil under pressure from a tank or the existing engine oil pump. The oil flow is restricted so that 15–20 cycles are necessary for the rotor to move from minimum C.R. to maximum C.R. Valve 44 still has its entry port positioned so that when the rotor 14 has moved down to the maximum C.R. rotor seal 16 no longer masks it and oil then flows freely out of the chamber 43 thus limiting the maximum C.R.

In operation, under low load idling conditions the rotor 14 would be in the maximum C.R. position with oil constantly cycling between valves 45 and 44. When the throttle is opened with the resultant high combustion pressure lifts valve 50 forces the rotor 14 up so that the next cycle will have a low C.R. and hence a low combustion pressure. Rotor 14 will then move down at a rate of about 0.175 mm per cycle (depending on size of restriction in valve 45) until the engine is running at optimum combustion pressure.

Regardless of the prevailing conditions, the rotor always draws in and expels a quantity of oil every cycle, this is necessary for rotor cooling and the actual amount is dictated by the size of the restriction in valve 45 and remains constant in relation to engine speed.

The engine can be readily supercharged by fitting a reed valve, as used in 2 stroke engines, to each inlet tract, upstream of the rotary valve. It is well known that the inlet valve in an engine, be it rotary or poppet valved, closing suddenly on a fast moving air/fuel charge, sets up pronounced pressure waves. The reed valve prevents these waves moving back out the inlet tract thus increasing the pressure of the charge between the reed valve and engine valve.

In such an arrangement, however, spring means are employed to move the rotor downwardly and draw in oil. For example the spring means can be in the form of four small springs mounted each end in a collar so as to extend between the lower face of wall 22 and top of rotor 14. During upward movement of the rotor the springs are compressed and thus provide the restoring force to move the rotor down.

Figure 6:
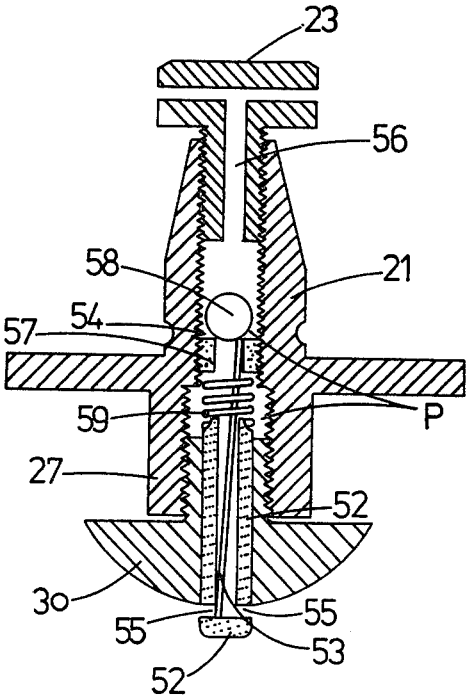
FIG. 6 is a part view of an axial spill port.

Referring to FIG. 6 there is shown an axial spill port P arrangement which is an alternative to the peripheral port. As it is necessary to ensure no gas exists in the oil pad any gas which does form can be bled off through the port. The port is located inside the vertical driveshaft 21 and has three main elements, a spill pin 52, elongate member 53 and check valve 54. In the drawing other elements bear the same reference numerals already used.

During operation of the engine rotor 14 is at the bottom of its stroke and spill pin 52 is at the bottom of its travel so the cross drillings 55 are in free communication with the oil pad. On the compression and expansion strokes the rotor moves up forcing oil out through the cross drillings 55 and check valve 54 to pass through passageway 56 in gear retaining bolt 23. This evacuation of oil continues until rotor 14 comes into contact with the bottom of spill pin 52 and pushes it up till cross drillings 55 are closed off. Rotor 14 then stops moving up but the spill pin continues to move up because of the hydraulic pressure. On the next exhaust and inlet strokes the rotor is sucked down by vacuum drawing oil in through the inlet valve and spill pin 52 is permitted to return to its original position as check valve 54 is held open until the spill port P opens thus breaking the vacuum between the two valves. The check valve is provided to prevent air being drawn into the oil pad. The ball element 58 of valve 54 locates on a seal which is adjustable in position in port P. To facilitate this the seat 57 is screw threaded on its peripheral surface and engages with the internal thread of port P. A spring 59 locates between the inner end of spill pin 52 and seat 57.

What is claimed is:

1. In a rotary valve operated internal combustion engine having a cylinder with a piston located for reciprocal movement within the cylinder, a cavity having walls located at the end of the cylinder in which, in use of the engine, combustion takes place, a valve member mounted within said cavity, an hydraulic fluid receiving chamber defined by the end of the valve member which is axially remote from the cylinder and the walls of said cavity, a shaft extending through one of the walls of said cavity which is opposite to said end of said valve member, said shaft being mounted for rotary movement, an inlet port, a spark plug port and an exhaust port all opening into said cavity, a combustion spaced formed in the valve member, drive means coupling said shaft to a crankshaft of the engine to which the piston is coupled whereby the combustion space in said valve member can be successively indexed with said inlet, spark plug and exhaust ports, an hydraulic fluid reservoir and inlet and outlet means coupling said reservoir to said hydraulic fluid receiving chamber whereby a determined volume of hydraulic fluid can be maintained within said chamber, the improvement comprising said valve member being coupled to the end of the shaft located within said cavity by said end of said shaft within said cavity having an angular cross-section, an opening in said end of said valve member which is axially remote from said cylinder having an angular cross-section corresponding to that of said end of said shaft, said end of said shaft extending through said opening and having an enlarged portion to prevent it from being withdrawn from said opening so that said valve member rotates with said shaft but can slide along said shaft in an axial direction with respect to the reciprocal movement of said piston, a passageway extending through said shaft, a valve situated in said passageway operated by an operating member which is moved in response to axial movement of said valve member to close off ports which open into said passageway at the end which is in engagement with said valve member.

2. In a rotary valve operated internal combustion engine having a cylinder with a piston located for reciprocal movement within the cylinder, a cavity having walls located at the end of the cylinder in which, in use of the engine, combustion takes place, a valve member mounted within said cavity, an hydraulic fluid receiving chamber defined by the end of the valve member which is axially remote from the cylinder and the walls of said cavity, a shaft extending through one of the walls of said cavity which is opposite to said end of said valve member, said shaft being mounted for rotary movement, an inlet port, a spark plug port and an exhaust port all opening into said cavity, a combustion spaced formed in the valve member, drive means coupling said shaft to a crankshaft of the engine to which the piston is coupled whereby the combustion space in said valve member can be successively indexed with said inlet, spark plug and exhaust ports, an hydraulic fluid reservoir and inlet and outlet means coupling said reservoir to said hydraulic fluid receiving chamber whereby a determined volume of hydraulic fluid can be maintained within said chamber, the improvement comprising said valve member being coupled to the end of the shaft located within said cavity such that the valve member rotates with said shaft but can slide along said shaft in an axially direction with respect to the reciprocal movement of said piston, inlet and outlet ducts are inserted at their inner ends into said inlet and outlet ports, said inner end of each duct being reduced to form a shoulder, and sealing means comprising a tubular seal fitted about said reduced inner end, a secondary seal fitted about said reduced inner end and located behind said tubular seal, and spring means disposed between said secondary seal and said shoulder on said duct to urge said seals into engagement with said valve member.

3. An engine as claimed in claim 2 wherein a gasket is provided between said shoulder and said respective port into which each said duct is inserted.

4. An engine as claimed in claim 1 or2 wherein said drive means comprises a bevel gear attached to said shaft at the free end thereof remote from said end in said opening which meshes with a second bevel gear attached to a drive shaft extending at substantially right angles to said shaft.

5. An engine as claimed in claim 1 or 2 wherein the surface of the valve member from which the shaft extends is recessed, said enlarged portion of said shaft being located in said recess said opening being formed in a retaining plate mounted on said surface and covering said recess.

6. An engine as claimed in claim 1 or 2 wherein said axial movement of the valve member is restricted to substantially 3 mm.

7. An engine as claimed in claim 1 or 2 wherein said cavity further includes a relief valve which is set to open at a predetermined combustion pressure, said relief valve being sealed by said valve member when the predetermined minimum combustion pressure has been attained.

* * * * *